US006498553B1

(12) United States Patent
Tanaka et al.

(10) Patent No.: US 6,498,553 B1
(45) Date of Patent: Dec. 24, 2002

(54) LAMINATED TYPE INDUCTOR

(75) Inventors: Tadashi Tanaka, Tekefu (JP); Hiromichi Tokuda, Takefu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/642,311

(22) Filed: Aug. 21, 2000

(30) Foreign Application Priority Data

Aug. 20, 1999 (JP) ..... 11-234088

(51) Int. Cl.[7] ..... H01F 27/02
(52) U.S. Cl. ..... 336/83; 336/200; 336/183
(58) Field of Search ..... 336/65, 83, 183, 336/200, 232, 223; 257/531; 29/602.1

(56) References Cited

U.S. PATENT DOCUMENTS 5,157,576 A * 10/1992 Takaya et al. ..... 361/321

FOREIGN PATENT DOCUMENTS

| | | |
|---|---|---|
| JP | 2-82007 | 6/1990 |
| JP | 6-50311 | 7/1994 |
| JP | 9-7835 | 1/1997 |

* cited by examiner

*Primary Examiner*—Lincoln Donovan
*Assistant Examiner*—Tuyen T. Nguyen
(74) *Attorney, Agent, or Firm*—Keating & Bennett, LLP

(57) ABSTRACT

A small-sized laminated inductor made via a simple firing process includes insulating magnetic sheets made of high permeability materials in which first coil conductors are provided on the surfaces thereof, insulating magnetic sheets made of low permeability materials in which second coil conductors are provided on the surfaces thereof, and other suitable materials. The first and second coil conductors are electrically connected in series through via holes provided in the magnetic sheets to define a spiral coil. In the spiral coil, the first coil conductors are wound in the counter-clockwise direction, while the second coil conductors are wound in the clockwise direction.

10 Claims, 3 Drawing Sheets

LAMINATED TYPE INDUCTOR

BACKGROUND OF THE INVENTION

1. Field of the Invention

The present invention relates to a laminated type inductor, more particularly, to a laminated type inductor used as a noise filter, and other suitable devices.

2. Description of the Related Art

Generally, when a laminated type inductor is used as a noise filter for a high-frequency signal line, low permeability material is used for a magnetic-substance layer. However, the laminated type inductor made of low permeability material has a problem in that it is easy to generate a link in the waveform of the high-frequency signal.

As a countermeasure, a conventional laminated type inductor 1 is shown in FIG. 5. The laminated type inductor 1 is constructed such that a high permeability coil section 2 including magnetic-substance layers made of high permeability materials, and a low permeability coil section 3 including magnetic-substance layers made of low permeability materials are laminated and integrally fired. Coil conductors 4–6 in the high permeability coil section 2 and coil conductors 7–9 in the low permeability coil section 3 are electrically connected in series through via holes (not illustrated) to define a spiral coil L. One end (coil conductor 9) of the spiral coil L is connected to an external electrode 11. The other end (coil conductor 4) thereof is connected to an external electrode 12.

Moreover, a laminated type inductor 21 is also shown in FIG. 6. A laminated type inductor 21 is constructed such that a high permeability coil section 22 including magnetic-substance layers made of high permeability materials, a low permeability coil section 23 including magnetic-substance layers made of low permeability materials, and an intermediate section 24 made of a non-magnetic material which is disposed between the coil sections 23 and 24 are laminated and integrally fired. Coil conductors 25–28 arranged in the high permeability coil section 22 and coil conductors 29–32 arranged in the low permeability coil section 23 are electrically connected in series through via holes (not illustrated) to define a spiral coil L.

In the conventional laminated type inductors 1 and 21, when the magnetic field H1 generated in the high permeability coil sections 2 and 22 and the magnetic field H2 generated in the low permeability coil sections 3 and 23 cause mutual interference, the noise suppressing effect is insufficient. To prevent the mutual interference of the magnetic fields H1 and H2, the laminated type inductor 1 shown in FIG. 5 has a large distance D between the coil conductors 4–6 of the high permeability coil section 2, and the coil conductors 7–9 of the low permeability coil section 3. However, as the distance D increases, the size of the laminated type inductor 1 also increases.

On the other hand, in the laminated type inductor 21 shown in FIG. 6 the intermediate section 24 is located between the high permeability coil section 22 and the low permeability coil section 233*gv* to prevent the mutual interference of magnetic fields H1 and H2. However, it is technically difficult to accomplish integrally baking both the magnetic material for the coil sections 22 and 23, and the dielectric material for the intermediate section 24, because the physical structure and the rate of heat-shrinking of both are substantially different. Thus, controlling the manufacturing processes is complicated.

SUMMARY OF THE INVENTION

To overcome the above-described problems, preferred embodiments of the present invention provide a small-sized laminated inductor with a substantially simplified baking process.

According to preferred embodiments of the present invention, a laminated type inductor including a low permeability coil section in which magnetic layers made of a relatively low permeability material and coil conductors are laminated, and a high permeability coil section in which magnetic layers made of a relatively high permeability material and coil conductors are laminated, the low permeability coil section and the high permeability coil section are laminated such that the coil conductors of the low permeability coil section and the coil conductors of the high permeability coil section are electrically connected in series to define a spiral coil, and the winding direction of the coil conductors in the low permeability coil section and the winding direction of the coil conductors in the high permeability coil section are opposite to each other.

When the low permeability coil section and the high permeability coil section are bonded together, since both of them are made of magnetic materials without using a different material, bonding reliability is substantially improved.

Moreover, since the winding direction of the coil conductors in the low permeability coil section and the winding direction of the coil conductors in the high permeability coil section are arranged in the opposite direction, mutual interference of the magnetic field produced in the low permeability coil section and the magnetic field produced in the high permeability coil section is prevented.

Other features, elements, characteristics and advantages of the present invention will become apparent from the following description of preferred embodiments thereof with reference to the attached drawings.

DETAILED DESCRIPTION OF PREFERRED EMBODIMENTS

Hereafter, preferred embodiments of the laminated type inductor according to the present invention are explained with reference to accompanying drawings.

Figure 1:
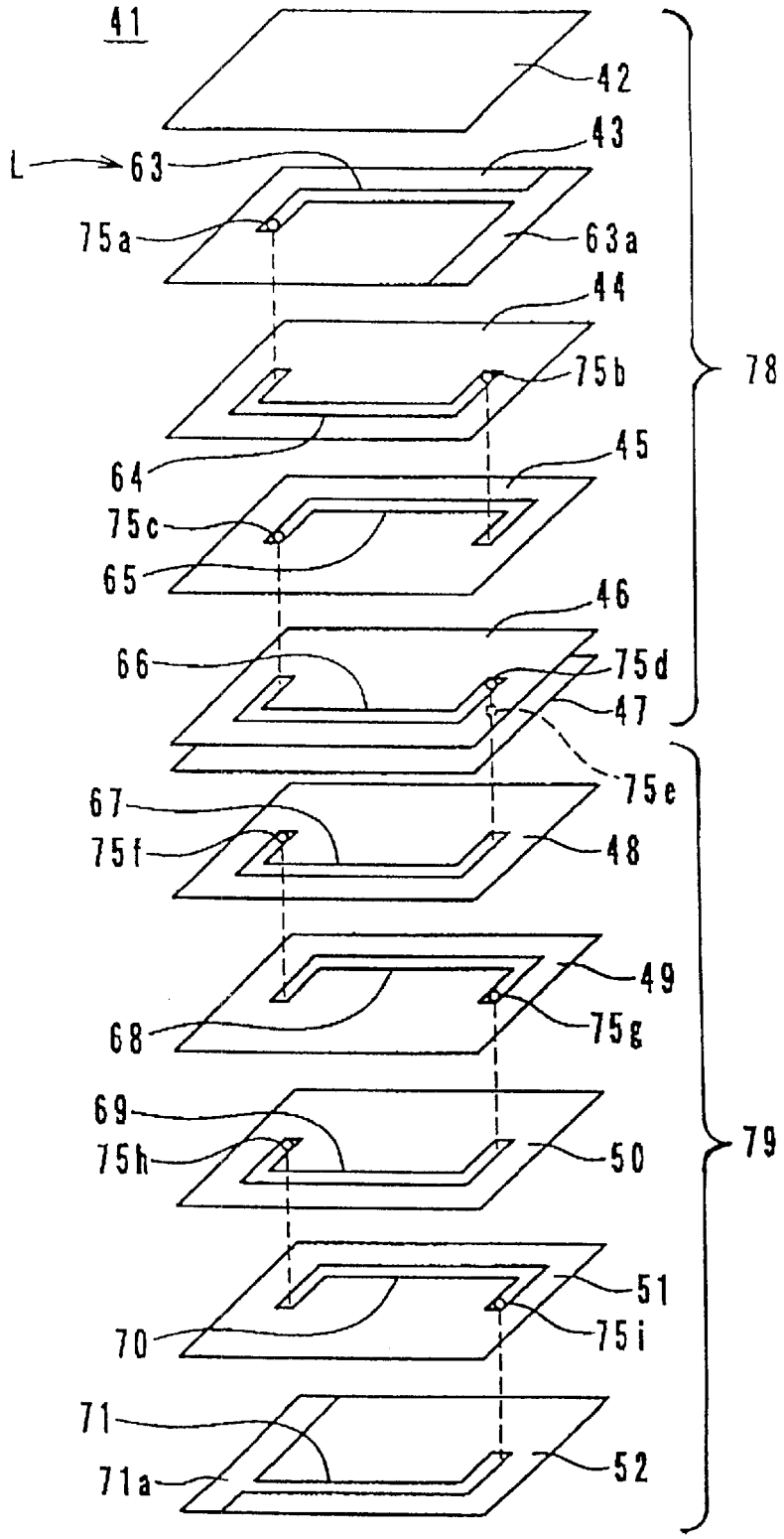
FIG. 1 is an exploded perspective view showing a preferred embodiment of a laminated type inductor according to the present invention.

As shown in FIG. 1, a laminated type inductor 41 includes insulating magnetic sheets 43–46 made of high permeability materials in which coil conductors 63, 64, 65, and 66 are respectively provided on the surfaces thereof, and insulating magnetic sheets 48–52 made of low permeability materials in which coil conductors 67, 68, 69, 70, and 71 are respectively provided on the surfaces thereof, and other suitable materials. The magnetic sheets 42–46 are produced, for example, such that insulating paste containing ferrite powder of high permeability is formed as a sheet. Similarly, the magnetic sheets 47–52 are produced, for example, such that insulating paste containing ferrite powder of low permeability is formed as a sheet.

The coil conductors 63–71 are electrically connected in series through via holes 75*a*–75*i* respectively provided in the magnetic sheets 43–51 to define a spiral coil L. In the spiral coil L, the coil conductors 63–66 are wound in the counterclockwise direction, while the coil conductors 67–71 are wound in the clockwise direction. A lead terminal 63*a* of the coil conductor 63 is exposed to the right side of the magnetic sheet 43. A lead terminal 71*a* of the coil conductor 71 is exposed to the left side of the magnetic sheet 52.

Figure 2:
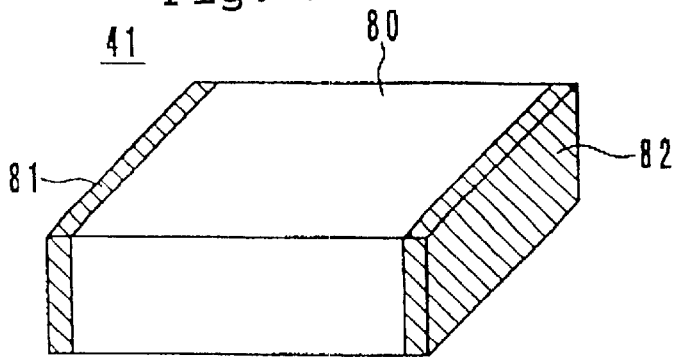
FIG. 2 is a perspective view of the laminated type inductor shown in FIG. 1.
Figure 6:
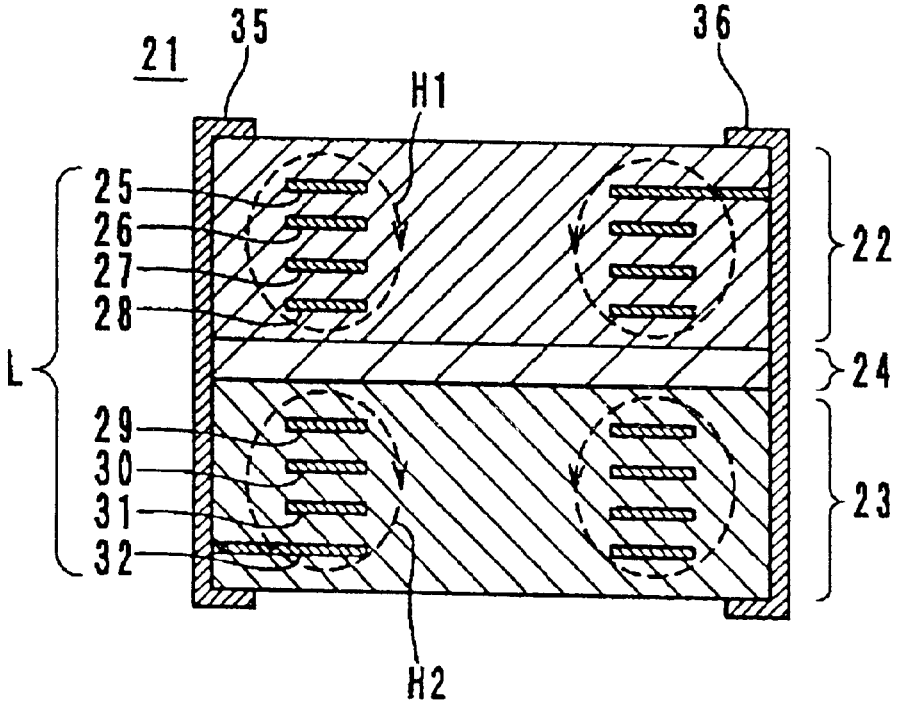
Fig. 6 PRIOR ART
FIG. 6 is a schematic sectional view showing another conventional laminated type inductor.

The above magnetic sheets 42–52, as shown in FIG. 1, are laminated in sequence, compressed to be bonded together, and baked integrally. Then the multilayer body 80 as shown in FIG. 2 is produced. Since each sheet 42–52 is made of magnetic material, the bonding property is greatly improved, as compared with the case where the different kinds of material are bonded in the conventional laminated type inductor 21 shown in FIG. 6.

External electrodes 81 and 82 are respectively provided on the right and left end surfaces of the multilayer body 80. The lead terminal 63*a* of the coil conductor 63 is connected to the external electrode 82. The lead terminal 71*a* of the coil conductor 71 is connected to the external electrode 81.

Figure 3:
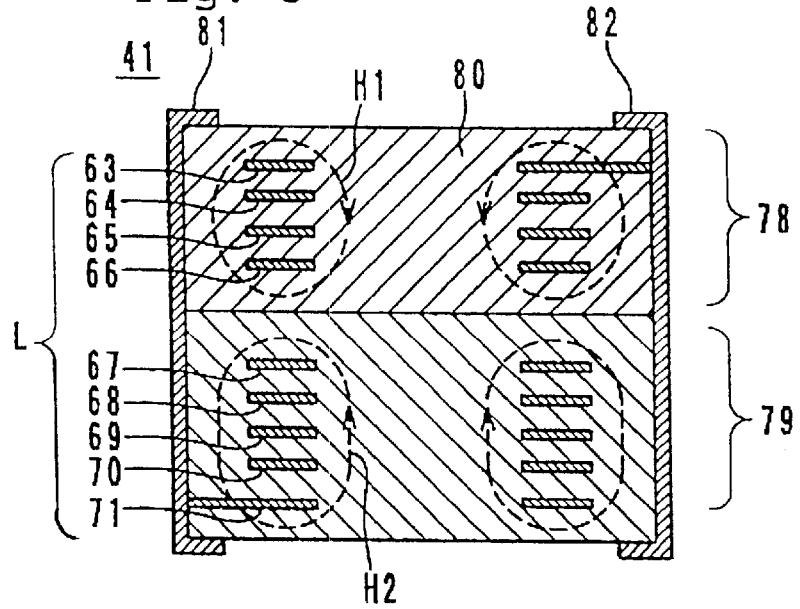
FIG. 3 is a schematic sectional view of the laminated type inductor shown in FIG. 2.

As shown in FIG. 3, in the laminated type inductor 41 both the high permeability coil section 78 in which the magnetic sheets 42–46 of the relatively high permeability are laminated, and the low permeability coil section 79 in which the magnetic sheets 47–52 of the low permeability are laminated are stacked directly upon one another without interposing the intermediate section made of dielectric material therebetween. Since the intermediate section is not required, the thickness thereof is reduced, thus producing a small-sized laminated inductor 41.

The coil conductors 63–66 of the high permeability coil section 78 eliminate low-frequency noises, and the coil conductors 67–71 of the low permeability coil section 79 eliminate high-frequency noises. Because the winding direction of the coil conductors 63–66 of the high permeability coil section 78, and the winding direction of the coil conductors 67–71 of the low permeability coil section 79 are opposite to each other, the magnetic field H1 produced in the high permeability coil section 78 and the magnetic field H2 produced in the low permeability coil section 79 do not cause mutual interference. Therefore, the impedance characteristic of the high permeability coil section 78 and the impedance characteristic of the low permeability coil section 79 respectively function independently. Consequently, the high permeability coil section 78 exhibits a sufficient low-frequency noise removal effect, and the low permeability coil section 79 exhibits a sufficient high-frequency noise removal effect.

Figure 4:
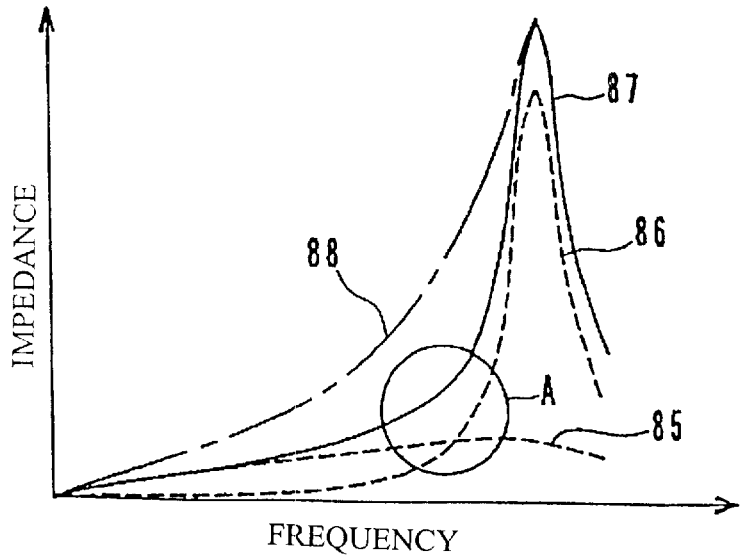
FIG. 4 is a graph showing the impedance characteristic of the laminated type inductor shown in FIG. 2.
Figure 5:
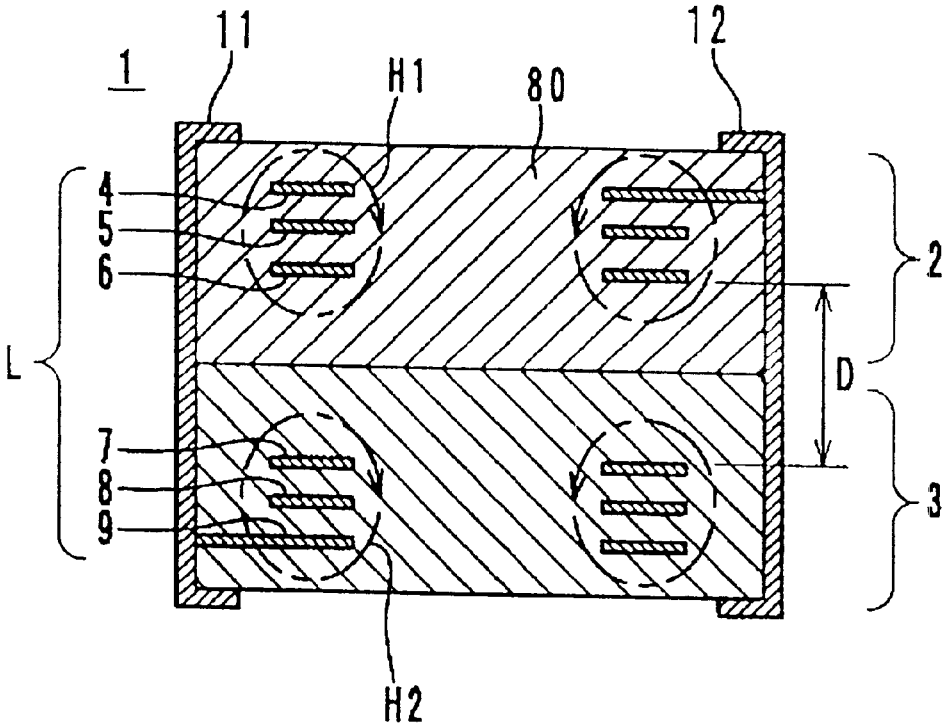
Fig. 5 PRIOR ART
FIG. 5 is a schematic sectional view showing a conventional laminated type inductor.

The impedance characteristic between the external electrodes 81 and 82 of the laminated type inductor 41 is shown in FIG. 4 (see solid line 87). In FIG. 4, a broken line 85 shows the impedance characteristic of the high permeability coil section 78. A broken line 86 shows the impedance characteristic of the low permeability coil section 79. The solid line 87 shows that the increase of the impedance is suppressed in the intermediate frequency band (indicated by circle A in FIG. 4). This is because the magnetic fields H1 and H2 respectively generated in the high and low permeability coil sections 78 and 79 repel mutually near the boundary of the high permeability coil section 78 and the low permeability coil section 79, and both the leakage of the magnetic field H1 to the low permeability coil section 79 and the leakage of the magnetic field H2 to the high permeability coil section 78 are minimized. For comparison, a dashed line 88 shows an impedance characteristic of a laminated type inductor in which the winding direction of the coil conductors 63–66 of the high permeability coil section 78, and the winding direction of the coil conductors 6–71 of the low permeability coil section 79 are arranged in the same direction.

In addition, the laminated type inductor according to preferred embodiments of the present invention is not limited to the above-described preferred embodiment, and various modifications are possible within the scope of the present invention. For example, the number of windings of the spiral coil, the shape of the coil conductor, or other features are modified in accordance with the characteristics of the product.

Furthermore, after stacking the magnetic sheets on which the coil conductors are respectively provided, the magnetic sheets of the above-mentioned embodiment are integrally baked. However, the present invention is not necessarily limited to this manufacturing process. For example, the magnetic sheets which are baked in advance may be used. Moreover, the inductor may be produced by the manufacturing method explained below. After forming a magnetic layer with a magnetic material paste by printing method or other suitable method, a conductive material paste is applied on the surface of the magnetic layer to form a coil conductor. Next, another magnetic material paste is applied on the coil conductor to define the magnetic layer in which the coil conductor is provided. Similarly, the conductive paste and the magnetic paste are applied in sequence alternately and repeatedly, while electrically connecting each of the coil conductors, whereby the inductor having the lamination structure is obtained.

As is clear from the above description, according to preferred embodiments of the present invention, since the low permeability coil section and the high permeability coil section are directly bonded together, and both of them are made of magnetic materials, the bonding property is excellent.

Since the high permeability coil section and the low permeability coil section are stacked without interposing the intermediate section made of dielectric material therebetween, a very small-sized laminated inductor is obtained.

Since the winding direction of the conductors of the low permeability coil section, and the winding direction of the conductors of the high permeability coil section are arranged opposite to each other, the magnetic field generated in the low permeability coil section and the magnetic field generated in the high permeability coil section do not cause mutual interference.

Therefore, the impedance characteristic of the high permeability coil section and the impedance characteristic of the low permeability coil section respectively work independently.

Consequently, the high permeability coil section exhibits a sufficient low-frequency noise removal effect, and the low permeability coil section exhibits a sufficient high-frequency noise removal effect.

While preferred embodiments of the invention have been disclosed, various modes of carrying out the principles disclosed herein are contemplated as being within the scope of the following claims. Therefore, it is understood that the scope of the invention is not to be limited except as otherwise set forth

What is claimed is:

1. A laminated type inductor comprising:

a low permeability coil section in which magnetic layers made of a relatively low permeability material and first coil conductors are laminated in a vertical stacking direction; and a high permeability coil section in which magnetic layers made of a relatively high permeability material and second coil conductors are laminated in said vertical stacking direction; wherein the low permeability coil section and the high permeability coil section are laminated such that the first coil conductors of the low permeability coil section and the second coil conductors of the high permeability coil section are electrically connected in series to define a spiral coil, and the winding direction of the first coil conductors in the low permeability coil section and the winding direction of the second coil conductors in the high permeability coil section are arranged to be opposite to each other; and in each of the high permeability section and the low permeability section, the first coil conductors and the second coil conductors are spaced from each other in said vertical stacking direction, adjacent pairs of the first coil conductors in said vertical stacking direction have substantially the same configuration and mutually opposite winding directions, and adjacent pairs of the second coil conductors in said vertical stacking direction have substantially the same configuration and mutually opposite winding directions.

2. The laminated type inductor according to claim 1, wherein the low permeability coil section and the high permeability section are laminated directly together.

3. The laminated type inductor according to claim 1, wherein the low permeability coil section and the high permeability section are baked integrally together.

4. The laminated type inductor according to claim 1, wherein the low permeability coil section and the high permeability section are all made of a magnetic material.

5. The laminated type inductor according to claim 1, wherein the magnetic layers of the low permeability coil section are made of paste containing ferrite powder of low permeability.

6. The laminated type inductor according to claim 1, wherein the magnetic layers of the high permeability coil section are made of paste containing ferrite powder of high permeability.

7. The laminated type inductor according to claim 1, wherein the low permeability coil section and the high permeability coil section are provided in a multilayer body.

8. The laminated type inductor according to claim 1, further comprising external electrodes provided on the right and left end surfaces of the multilayer body.

9. The laminated type inductor according to claim 1, wherein the coil conductors of the high permeability coil section are arranged to eliminate low-frequency noises, and the coil conductors of the low permeability coil section are arranged to eliminate high-frequency noises.

10. The laminated type inductor according to claim 1, wherein the high permeability coil section and the low permeability coil section are stacked without interposing an intermediate section made of dielectric material therebetween.

* * * * *